United States Patent [19]

Bartkowski et al.

[11] Patent Number: 5,009,756

[45] Date of Patent: Apr. 23, 1991

[54] CHEMICAL METHOD OF AVOIDING A RAINBOW EFFECT CAUSED BY THE LAYER OF OXIDE PRODUCED UPON THE BRIGHTENING OF PARTS OF ALUMINUM OR ALUMINUM ALLOYS

[75] Inventors: Klaus-Dieter Bartkowski, Krefeld; Peter Venn, Wuppertal, both of Fed. Rep. of Germany

[73] Assignee: Gebr. Happich GmbH, Fed. Rep. of Germany

[21] Appl. No.: 527,587

[22] Filed: May 23, 1990

[30] Foreign Application Priority Data

May 26, 1989 [DE] Fed. Rep. of Germany ..... 3917186

[51] Int. Cl.[5] ..... C25D 11/24; C25F 3/20

[52] U.S. Cl. ..... 204/129.35; 204/129.75; 204/140; 204/141.5

[58] Field of Search ..... 204/129.35, 129.75, 204/140, 141.5, 144, 144.5, 146, 36, 37.6

[56] References Cited

U.S. PATENT DOCUMENTS

| | | | |
|---|---|---|---|
| 2,040,617 | 5/1936 | Mason et al. | 204/141.5 X |
| 2,040,618 | 5/1936 | Mason et al. | 204/141.5 X |
| 2,108,603 | 2/1938 | Mason | 204/129.75 X |
| 2,153,060 | 4/1939 | Guthrie | 204/129.75 X |
| 2,708,655 | 5/1955 | Turner | 204/140.5 |
| 2,721,835 | 10/1955 | Axtell | 204/38 |
| 3,957,553 | 5/1976 | Smith | 204/141.5 X |

*Primary Examiner*—John F. Niebling
*Assistant Examiner*—William T. Leader
*Attorney, Agent, or Firm*—Ostrolenk, Faber, Gerb & Soffen

[57] ABSTRACT

There is described a chemical method for the avoidance of a rainbow effect which is caused by the layer of oxide produced upon the brightening of parts of aluminum or aluminum alloys, in which the parts are degreased or cleaned in a first process step and then subjected to electrolytic-alkaline brightening in a second process step, the method being characterized by the fact that, after the brightening, the parts are subjected to a further treatment in which the parts are first of all washed in water and then exposed in a chromic-acid solution preferably containing about 50 grams per liter of $CrO_3$ at about 98° C. for about 3 minutes and finally washed again in a sodium hydrosulfite solution.

3 Claims, No Drawings

CHEMICAL METHOD OF AVOIDING A RAINBOW EFFECT CAUSED BY THE LAYER OF OXIDE PRODUCED UPON THE BRIGHTENING OF PARTS OF ALUMINUM OR ALUMINUM ALLOYS

BACKGROUND OF THE INVENTION

The present invention refers to a chemical method of avoiding a rainbow effect which is caused by the layer of oxide produced upon the brightening of parts of aluminum or aluminum alloys, in which the parts are degreased or cleaned in a first process step and then brightened electrolytically/alkalinely in a second process step.

Aluminum parts, such as aluminum stampings or rolled sections are used, inter alia, in the hardware and lighting industries or, in particular, also in automobile manufacture, for instance for window mounting systems, or else as ornamented frames, ornamented moldings or the like. It is also known to use parts of aluminum or aluminum alloy which have a colored anodized surface.

Such aluminum or aluminum-alloy parts are, regardless of whether they are to be left in their natural color or are to be colored, first of all ground and, if necessary, then polished, degreased and brightened, the parts being treated for the brightening in an alkaline electrolyte which is subjected to DC current. It has been found that as a result of the layer of oxide which is produced upon the brightening of the parts, a rainbow effect in irridescent colors, which is extremely undesired, is produced. While the aforementioned effect is as a rule only slightly visible in the case of colorless (natural-color) anodized layers, it is frequently so strong, particularly in the case of colored anodized layers, that it is no longer acceptable. Treatment of the parts in chromic/-phosphoric acid solutions has already been proposed. However, it has been found that such a treatment leads to a reduction in gloss and to an initial etching of the previously alkalinely brightened aluminum parts, so that such a treatment of the parts is unacceptable in practice.

SUMMARY OF THE INVENTION

The obJect of the present invention is to provide a chemical method of avoiding a rainbow effect caused by the oxide layer produced upon the brightening of parts of aluminum or aluminum alloy.

In accordance with this invention, this object is achieved, starting from a method of the aforementioned type, by, after the brightening, subjecting the parts to a further treatment in which they are first washed in water and then exposed in a chromic acid solution, whereby the oxide layer or film is removed, and finally washed in a sodium hydrosulfite solution. Washing in sodium hydrosulfite solution results in the reduction of hexavalent chromium to trivalent chromium.

Experiments carried out have shown that operating in accordance with the above teaching leads to the avoidance of the rainbow effect without having a negative effect on the previously brightened aluminum.

The parts which have been treated in this manner can be left in their natural color or else colored. For coloring, the parts are exposed in a subsequent process step an electrolyte containing a metal salt and subjected to alternating current and then chemoabsorbtively colored in a further process step in a dye bath containing azo dye.

DESCRIPTION OF THE PREFERRED EMBODIMENT

In a preferred embodiment, the aluminum or aluminum alloy parts, after brightening as described above, are washed in water and exposed in a chromic acid solution containing about 50 grams per liter of $CrO_3$ at about 98° C. for about three minutes. The parts are then washed in a sodium hydrosulfite solution.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for avoiding a rainbow effect which is caused by the layer of oxide produced in the electrolytic-alkaline brightening of aluminum or aluminum alloy parts, comprising, after said brightening, subjecting said parts to a further treatment in which the parts are first washed in water and then exposed in a chromic acid solution and finally washed in a sodium hydrosulfite solution.

2. A method according to claim 1, wherein said aluminum or aluminum alloy parts are degreased or cleaned prior to said electrolytic-alkaline brightening.

3. A method according to claim 1 wherein said chromic acid solution contains about 50 grams per liter of $CrO_3$ and said aluminum or aluminum alloy parts are exposed in said chromic acid solution at about 98° C. for about 3 minutes.

* * * * *